United States Patent [19]

Ohlsson

[11] 4,358,996

[45] Nov. 16, 1982

[54] ROTARY OFFSET PRINTING PRESS

[75] Inventor: Jarl E. S. I. Ohlsson, Stockholm, Sweden

[73] Assignee: Texogesa, S.A., Switzerland

[21] Appl. No.: 24,662

[22] Filed: Mar. 28, 1979

Related U.S. Application Data

[63] Continuation of Ser. No. 856,844, Dec. 1, 1977, abandoned, which is a continuation of Ser. No. 681,199, Apr. 28, 1976, abandoned, which is a continuation-in-part of Ser. No. 624,259, Oct. 20, 1975, abandoned, which is a continuation of Ser. No. 500,550, Aug. 26, 1974, abandoned.

[30] Foreign Application Priority Data

Aug. 28, 1973 [CH] Switzerland ..... 12278/73
Jul. 31, 1974 [CH] Switzerland ..... 10554/74

[51] Int. Cl.[3] ..... B41F 31/06; B41L 27/08

[52] U.S. Cl. ..... 101/217; 101/350; 101/363; 101/DIG. 24

[58] Field of Search ..... 101/350, 363, 364, 207, 101/208, 210, 148, 217, 218; 118/118, 119, 262

[56] References Cited

U.S. PATENT DOCUMENTS

| | | | |
|---|---|---|---|
| 2,560,572 | 7/1951 | Haywood et al. | 101/350 X |
| 2,631,643 | 3/1953 | Schueler | 101/364 X |
| 2,676,563 | 4/1954 | Montgomery et al. | 101/350 X |
| 2,729,192 | 1/1956 | Warner | 101/363 X |
| 2,946,307 | 7/1960 | Warner | 118/259 X |
| 2,969,016 | 1/1961 | Crosfield et al. | 101/202 |
| 2,970,564 | 2/1961 | Warner | 101/363 X |
| 3,182,632 | 5/1965 | Vazdikis | 101/350 X |
| 3,190,218 | 6/1965 | Willard | 101/182 X |
| 3,283,712 | 11/1966 | Chambon | 101/364 X |
| 3,559,572 | 2/1971 | Hackley | 101/350 |
| 3,592,134 | 7/1971 | Patterson, Jr. | 101/269 |
| 3,701,335 | 10/1972 | Barnscheidt | 101/350 X |

FOREIGN PATENT DOCUMENTS

| | | | |
|---|---|---|---|
| 420696 | 10/1925 | Fed. Rep. of Germany | 101/363 |
| 988559 | 4/1965 | United Kingdom | 101/363 |

*Primary Examiner*—J. Reed Fisher
*Attorney, Agent, or Firm*—Robert E. Burns; Emmanuel J. Lobato; Bruce L. Adams

[57] ABSTRACT

A greasy ink printing press including a rubber coated inking cylinder coacting with a plate cylinder has an inking device comprising a wiping cylinder formed by a small diameter rod pressed against the inking cylinder in a zone of downward movement thereof, with an ink trough formed in the space above the zone of contact of the rod and inking cylinder. A variable-speed electric motor rotates the rod in the same direction of rotation as the inking cylinder to laminate the ink between the rod and inking cylinder and provide a counter-current wiping of the inking cylinder. The rod may be reciprocated longitudinally to remove streaks.

10 Claims, 10 Drawing Figures

FIG. 4
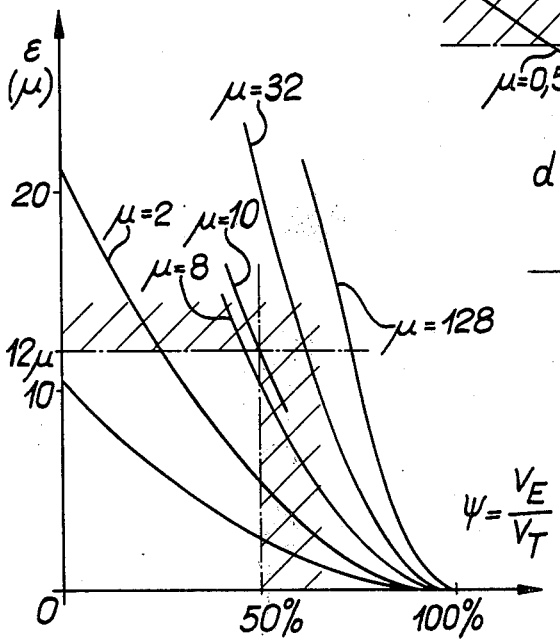
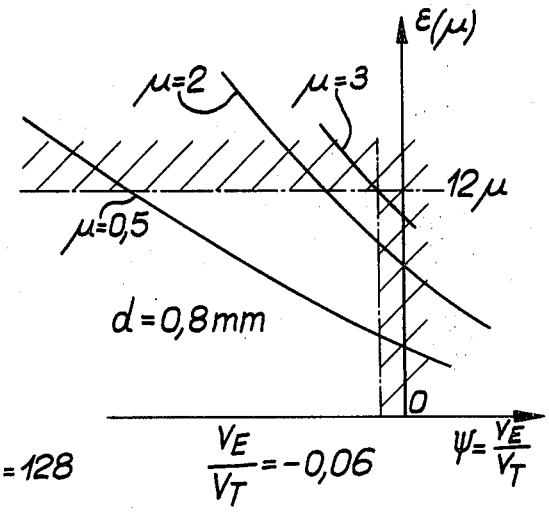
FIG. 5
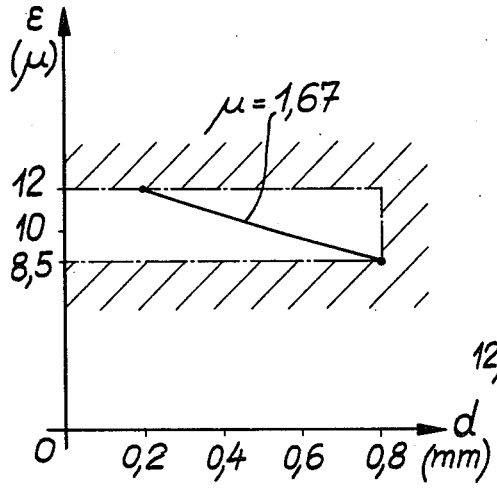
FIG. 6
FIG. 7
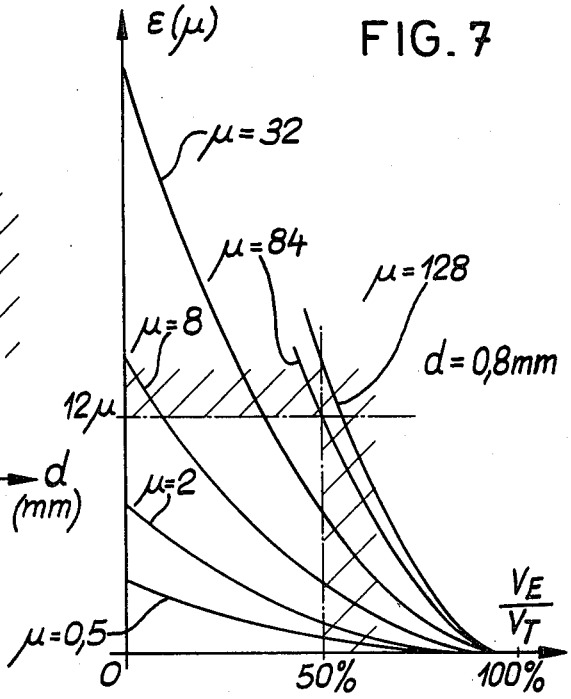

ROTARY OFFSET PRINTING PRESS

CROSS-REFERENCE TO PRIOR APPLICATIONS

The present application is a Rule 60 Continuation of application Ser. No. 856,844 filed Dec. 1, 1977 (now abandoned) which was a Rule 60 Continuation of Application Ser. No. 681,199 filed Apr. 28, 1976 (now abandoned) which was a Continuation-In-Part of Application Ser. No. 624,259 filed Oct. 20, 1975 (now abandoned) which was a Rule 60 Continuation of Application Ser. No. 500,550 filed Aug. 26, 1974 (now abandoned).

BACKGROUND OF THE INVENTION

The invention concerns inking devices for greasy-ink printing, for use notably in printing presses such as offset and direct typographical printing presses for greasy ink printing.

In these machines, ink is spread on gravure plates by inking cylinders covered with soft material, in general synthetic rubber. The inking cylinders are adjusted to have a minimum but sufficient contact with the plate or gravure cylinder, and it is generally accepted that the film of ink trapped in the contact zone is separated into two films at the downstream end in the direction of rotation.

To obtain an imprint of good quality, the thus-spread greasy ink must have a relatively high static viscosity, as well as a certain tackiness.

Spreading of the ink is facilitated by the thixotropical properties of the inks which provide an important reduction in their viscosity during lamination of the ink, and the modern tendency is directed towards gels having favorable rheological properties. Greasy inks at present in use and which enable good quality printing generally have a dynamic viscosity comprised between 50 and 100 poises. The inking device for these inks must thus be capable of laminating an ink having a viscosity in the given range.

Lamination of the ink in the inking device consists of providing on the inking roller a film of ink as uniform as possible and sufficiently thin not to clog the gravure. From calculations based on the thickness of ink which must be transferred onto the paper or other support to obtain a correct imprint, the optimum thickness of this film must be of the order of 12 microns.

To obtain a good quality imprint in a greasy ink press, it is thus necessary to:

laminate a greasy ink at the speed of operation of the printing press and with a sufficiently high viscosity (of the order of 50 to 100 poises);

form by this lamination a film of ink having a thickness of about 12 microns on an inking cylinder coated with soft rubber;

and ensure that this film is as regular as possible.

There are already known inking devices which satisfy the condition of providing a film of uniform thickness, but cannot fulfil the conditions of the first two operations. One of these inking devices as disclosed in Chambon U.S. Pat. No. 3,283,712 includes a wiping cylinder of hard material applied with pressure against an inking cylinder of soft rubber rotating at the tangential speed $V_T$ of the plate cylinder. The wiping cylinder has a peripheral wiping speed $V_E$ and rotates in the same direction as the inking cylinder, i.e. in the zone of contact of the two cylinders they move in opposite directions. A mass of ink is lodged in the space above the zone of contact of the two cylinders, and is held in this space by a scraper touching the upper part of the wiping cylinder. The ink is thus laminated during passage between the two cylinders.

Experience has shown that such an inking device operates correctly for a ratio of wiping $V_E/V_T$ between 0 and 0.5 and that above 0.5, there is a generation of difficult-to-absorb vibrations which produce visible streaks in the imprint. Also, in its range of satisfactory operation, this device involves important losses of ink due to the difficulties of adjustment between the scraper, the wiping cylinder and the lateral cheeks of the ink trough. Experience also shows that to obtain a film of ink having a thickness of 12 microns on the inking cylinder, the maximum permitted viscosity for the ink is 10 poises, which value is not compatible with greasy inks so tht use of such a device is limited to fluid inks.

A second known inking device employs even more fluid inks. This device includes a wiping cylinder of very small diameter, resembling a rod, for the purpose of facilitating lamination of thin films, which is slowly rotated in the opposite direction to the inking cylinder. Such a device has the advantage of being simple to provide but experience once again shows that only a low maximum viscosity of ink may be used; it is of the order of 3 poises. It is thus evident that this latter inking device is not suitable for printing with a greasy ink.

The present invention aims to remedy the drawbacks and insufficiencies of the known inking devices by providing a device of simple conception enabling lamination of a relatively high viscosity ink and which may be used in printing presses of the typographical and offset litho types to give an excellent imprint.

SUMMARY OF THE INVENTION

According to the invention, there is provided, in a printing press for greasy ink printing, notably presses of the typographical and offset litho types, including an inking cylinder of soft material such as rubber coacting with a plate cylinder, an inking device comprising a wiping rod of small diameter applied with pressure against the inking cylinder in a zone of downward movement thereof, means for forming an ink reservoir in a space disposed above the zone of contact of said rod and the inking cylinder, and means for rotatably driving said rod in the same direction of rotation as the inking cylinder to laminate the ink between said rod and the inking cylinder and to provide a counter current wiping of the inking cylinder.

The inking device according to the invention enables the obtention of a film of greasy ink of regular and uniform thickness with an ink of high viscosity which may reach 84 poise, without producing losses of ink. Also, the adjustment of the thickness of the film of ink, at the periphery of the inking cylinder may take place in a very simple manner by varying the speed of rotation of the wiping rod in relation to that of the inking cylinder.

BRIEF DESCRIPTION OF THE DRAWINGS

An embodiment of the invention will now be described, by way of example, with reference to the accompanying drawings, in which:

FIGS. 4, 5 and 6 are graphs showing the variation of the thickness of the film of ink as a function of different parameters, obtained with known inking devices; and FIG. 7 is a similar graph showing variation in the thickness of the film of ink as a function of the ratio of wiping for inks of various viscosities, obtained with an inking device according to the invention.

DESCRIPTION OF THE PREFERRED EMBODIMENTS

Figure 1:
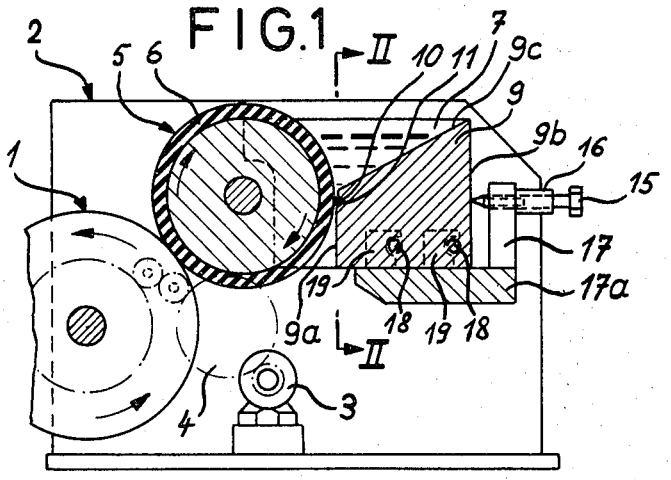
FIG. 1 is a schematic view, partly in vertical cross-section of an inking device according to the invention.
Figure 2:
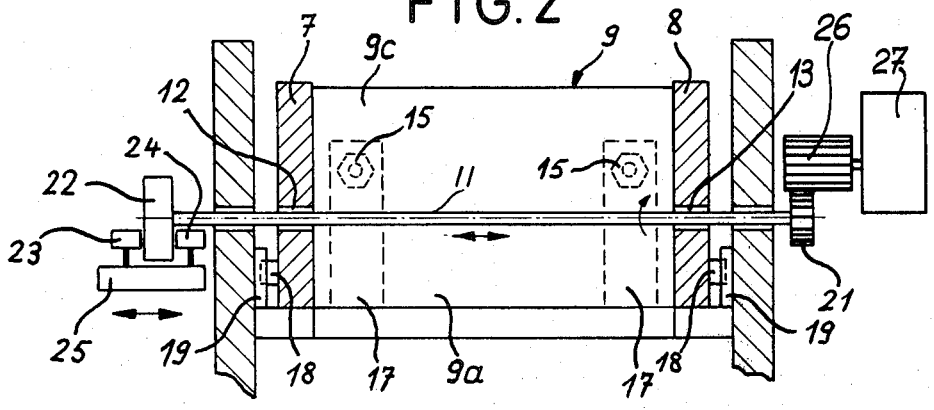
FIG. 2 is a schematic cross-section taken along line II—II of FIG. 1.

The inking device according to the invention is associated with a plate cylinder 1, which is engraved or carries an engraved plate for inking. Cylinder 1 is rotatably mounted on a frame 2 and is driven by an electric motor 3 via a gear train 4 or another equivalent conventional mechanism. With this cylinder 1 coacts at the same peripheral speed, an inking cylinder 5 rotatably mounted on frame 2, and coupled with cylinder 1. The shafts of cylinders 1 and 5 are parallel and horizontal and the cylinders rotate in opposite directions as indicated by the arrows. The inking cylinder 5 has a surface layer 6 of flexible plastics material, for example synthetic rubber and it is this layer which provides transfer of ink onto the surface of plate cylinder 1, by means which include elastic properties of layer 6, as will be noted in greater detail hereinafter.

The device according to the invention comprises an ink trough formed basically of two vertical lateral side-plates 7, 8 between which extends a generally horizontal crosspiece or body 9. This body 9 extends along the entire length of the inking cylinder 5 and has, in the proximity of the latter, in a forward vertical face 9*a*, a horizontal groove 10, for example of V-section as shown, in which is lodged a horizontal rod 11, having a circular section of small diameter, whose end parts are lodged in aligned holes 12,13 respectively in the sides-plates 7 and 8.

Figure 3:
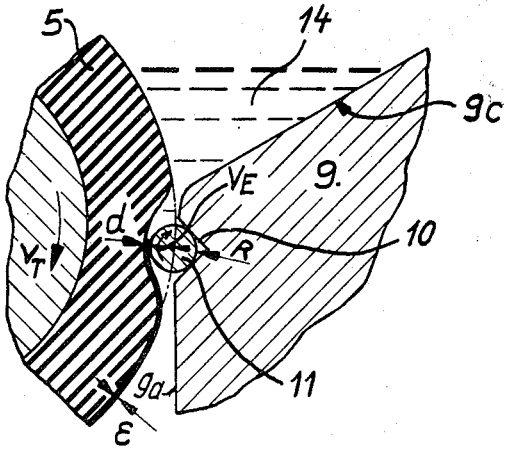
FIG. 3 shows a detail of FIG. 1 on an enlarged scale.

Elements 5 and 6 provide an elastic inking cylinder. As shown in FIGS. 1 and 3, the diameter of rod 11 is small in comparison with the diameter of this elastic inking cylinder. As illustrated in FIG. 3, the ratio of the diameter of the rod 11 to that of the inking cylinder 5 is about 1/12.

The rod 11 is pressed against the flexible surface layer 6 of the inking cylinder 5 and it defines the bottom of the ink trough defined laterally by the side-plates 7 and 8, which contains a mass of ink 14.

The contact between the rod 11 and the periphery of the inking cylinder 5 takes place in a zone of downward movement of the cylinder surface, preferably substantially in the horizontal plane passing through the axis of rotation of the cylinder 5, as shown, where said movement is vertically downward, as indicated by the arrow in FIG. 3.

The body 9 is pressed toward the inking cylinder 5 and thereby the rod 11 is pressed into contact with the elastic periphery 6 of the inking cylinder 5. In this periphery 6 the rod 11 forms an elongate depression 6′ parallel to and receiving this rod, at the time of contact, subject to elastic return of the periphery to its normal contour 6″. This elastic depression 6′ of periphery 6 is obtained by an appropriate means formed in this example by screws 15 screwed in tapped sleeves 16 carried by vertical bars 17 secured on a transversal horizontal support 17*a* on which the body 9 and side-plates 7, 8 are slidably mounted. The ends of screws 15 bear against a rear face 9*b* of body 9 opposite the front face 9*a* carrying rod 11.

The assembly formed by the side-plates 7, 8 and body 9 is mounted on the frame 2 in a manner to be easily removed. For this purpose it includes pins 18 fixed on and protruding outwardly from the side-plates 7,8. These pins 18 engage in rearwardly-open recesses formed in hook-shaped parts 19 secured on frame 2.

Towards the front, the side-places 7, 8 extend beyond the periphery of the inking cylinder 5 in the immediate proximity of the two lateral end faces of this cylinder. In this manner, the ink 14 is confined in the trough limited by the side-plates 7,8, the peripheral surface of the cylinder 5 above rod 11 and the upper face 9*c* of body 9 which is inclined downwardly towards the inking cylinder 5.

The rod 11 which acts as a wiping rod of small diameter is rotatably driven in the same direction of rotation as the inking cylinder 5. For this purpose, the end of the rod 11 protruding through side-plate 8 is integral with a pinion 21 engaging with a toothed wheel 26 integral with the shaft of a variable-speed electric motor 27. Alternatively, the rod 11 could be directly coupled to the shaft of motor 27.

Also, since the rod 11 passes through side-plates 7 and 8, it is easy to provide means for transversely reciprocating of rod 11 to wipe out possible longitudinal streaks. To this end, the other end of rod 11 protruding from the side-plate 7, may carry a disc 22 held between a pair of rollers 23, 24 secured on a support 25 which is reciprocated transversely to provide a corresponding reciprocation of rod 11.

Reference is now made to FIG. 3 as well as to the graphs of FIGS. 4 to 7, to explain the operation of the device according to the invention and to compare the performance with that of prior devices. With respect to the thickness of the laminated film (desirably several microns, as noted) compared to the penetration d (several tenths of millimeter) of the rod 11 in the inking cylinder 5, the mathematical analysis of the system, based on Newton's formula of shearing stress, leads to the following equations:

$$h_0^4 = K\frac{\mu_2}{E^2}V_T^2\frac{R}{d}$$

$$\epsilon = \frac{h_0}{2}\left(1 - \frac{V_E}{V_T}\right)^2$$

in which $h_o$ is the thickness of the laminated film for a zero rotation of rod 11, $\mu$ is the viscosity of the greasy ink, E the elasticity of the surface 6 of inking cylinder 5, R the radius of rod 11, d the penetration of rod 11 in the inking cylnder 5, $\epsilon$ the thickness of the film of the cylinder 5 after lamination, and $V_E$ and $V_T$ respectively the peripheral speeds of rod 11 and inking cylinder 5.

The graph of FIG. 4 illustrates the curves giving the variation of the thickness of the film of ink at the periphery of the cylinder 5, as a function of the wiping ratio $\psi = V_E/V_T$ in the case of a first known inking device referred to above of the type in which a wiping roller of relatively large diameter rotates in the same direction as the inking cylinder. In the zone of satisfactory operation of such a device for which the wiping ratio $\psi$ is from 0 to 50%, it can be seen that to produce at the periphery of the inking cylinder a film having a thickness of 12 microns, the maximum permitted viscosity for the ink is 10 poises, which is not suitable for printing presses of the typographical or offset litho type.

FIGS. 5 and 6 are graphs illustrating the variation of the thickness $\epsilon$ of the film of ink respectively as a function of the wiping ratio $\psi$ and of the penetration d, in the case of the second known inking device including a rod in contact with the inking cylinder but turning in the opposite direction thereto. In this known prior device, the ratio of the diameters was 16 to 1 and the rates of rotation of the rod and wiping cylinder were equal, so that the ratio of the tangential speeds, i.e. $\psi = V_E/V_T$, was equal to about $-0.06$. This wiping ratio was, incidentally, nonadjustable. As can be seen from FIG. 5, the maximum viscosity of the laminated ink can in no case exceed 3 poises, while FIG. 6 shows that to obtain a regulation of the thickness $\epsilon$ of from 8.5 to 12 microns by the adjustment of the pressure and hence penetration d, the viscosity must be limited to 1.67 poises. Here again, such a device cannot be used with greasy inks whose viscosity is greater than 50 poises.

To the contrary, the graph of FIG. 7 which gives the variation of the thickness $\epsilon$ in microns as a function of the wiping ratio $V_E/V_T$ in the case of the device according to the invention, in which the small diameter rod 11 turns in the same direction as the inking cylinder 5, shows that by varying the speed of this rod 11, it is possible to laminate an ink of relatively high viscosity able to reach 84 poises, while remaining in an acceptable range of the wiping ratio $V_E/V_T$ comprised between 0 and 50%. Consequently, it is clear that this device is suitable for printing presses of the typographical and offset litho types, using high viscosity greasy inks.

In relation to the first known inking device, with a large diameter wiping cylinder, the device according to the invention also has the advantage that it enables a reduction of the power consumption and hence a reduction of heating and a simplification of cooling problems.

The bearing surface 10 of the rod 11 in the ink trough may be either in very hard metal, or in an elastomer having a coefficient of elasticity E many (i.e. several hundreds) times greater than the coefficient of elasticity of the inking cylinder 5. In the case where the bearing surface 10 is constituted of an elastomer, the film of laminated ink on the bearing of rod 11 serves as a lubricant and its very slight thickness, due to the very high coefficient of elasticity of the elastomer, is negligible so that it does not affect, in an appreciable manner, the thickness of film formed on the inking cylinder 5.

It is possible to servo-control the electric motor 27, which enables variation of the speed of rotation of the wiping rod 11, by a transducer 27' responsive to the density of ink on the imprint provided (a reader of this density) so as to always have a correct imprint.

Although previously it has been indicated that the device according to the invention enables the use of an ink whose viscosity can reach 84 poises, of course this value, which was obtained in specific experimental conditions, for a given radius R of the rod 11 and a given penetration d, should not in any way be considered as limiting and greasy inks having a viscosity greater than 84 poises may be employed with other values of the stated parameters.

Figure 8:
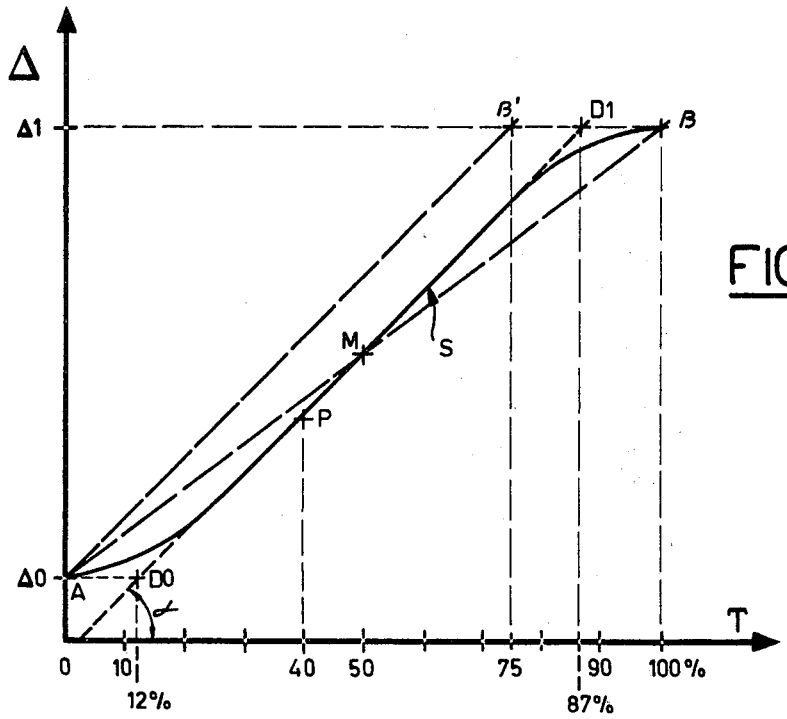
FIGS. 8 and 9 are graphs showing interrelations of fineness and enlargement.
Figure 9:
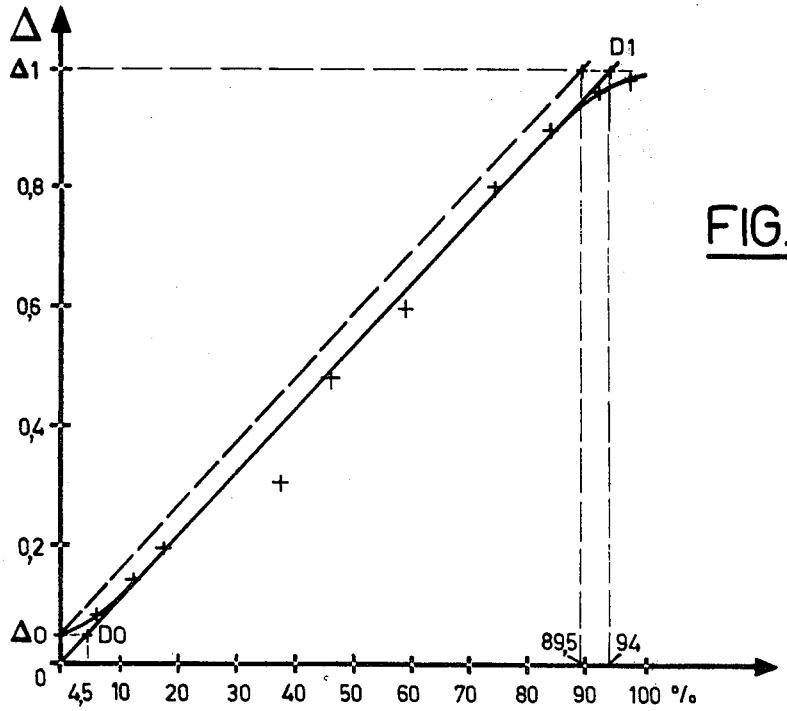

Additional tests have been conducted, the results of which are shown in FIGS. 8 and 9. In these tests, it has not been tried to directly measure the thickness of the obtained film, because the purpose of said device according to the invention is to allow printing under usual conditions and not to form a film of given thickness what is only an intermediate step. Therefore, the control of the thickness has been carried out by measuring the density of the printing flat tint by means of a reflexion densimeter.

The following Table 1 shows the results of 3 series of tests, in which the wiping speed has been adjusted after each variation of the parameters machine speed and penetration, in order to bring the density $\Delta$ to a fixed value (that is 1:1; 1:2 and 1:3 for each tests series, respectively).

The ink used was a Magenta ink for offset rotary printing-press, the rest density of which was 375 poises. For this used tint, the normal density of the flat tint was of 1:2.

For each case defined by a determined value of respectively $\nu$, $\Delta$ and d, it is shown in Table I the rate of rotation of the wiping rod in r.p.m. and the value of the corresponding wiping ratio in %.

TABLE I

| | | α | | | |
|---|---|---|---|---|---|
| Δ | $V_{m/mn}$ | 0.3I mm | 0.62 mm | 0.93 mm | I.25 mm |
| | 20 | I070/67.2 | I020/64.I | 990/62.2 | 950/59.7 |
| I.I | 30 | I700/7I.2 | I630/68.3 | I590/66.6 | I530/64.I |
| | 40 | 2480/77.9 | 2340/73.5 | 2200/69.I | 2I00/66 |
| / | 20 | I000/62.8 | 9I0/57.2 | 870/54.7 | 8I0/50.9 |
| I.2 | 30 | I600/67 | I490/62.4 | I450/60.7 | I400/58.6 |
| | 40 | 2260/7I | 2I50/67.5 | 2060/64.7 | I970/6I.9 |
| | 20 | 850/53.4 | 760/47.8 | 690/43.4 | 630/39.6 |
| I.3 | 30 | I390/58.2 | I260/52.8 | II80/49.4 | I090/45.7 |
| | 40 | 2000/62.8 | I840/57.8 | I720/54 | I660/52.2 |

INFLUENCE OF THE PENETRATION

As is shown on the horizontal lines of the above Table I, the penetration has only a little effect on the thickness of the film. As a matter of fact, a small variation of the wiping rate is required to maintain constant said thickness when the penetration is varying in a ratio of 4 (0.31 to 1.25).

This weak influence of the penetration is in agreement with the theory, since the thickness $h_O$ of the film varies as the inverse of the fourth root of said penetration d.

INFLUENCE OF THE MACHINE SPEED

This influence has been studied for a penetration of 0.93 mm, which is approximately the medium of the penetration range used in practice (0.6 to 1.3 mm) with an inking cylinder having a hardness of 50 shores.

Under 0.6 mm, the influence of the penetration on the film begins to become important and, above 1.3 mm, the mechanical strains become important and may lead to wear and deformation without appreciably decreasing the thickness of the film. Furthermore, formula (1) is showing how $h_o$ is varying as $\sqrt{\nu}$.

In th following Table II, the wiping speeds $V_E$ are given, which correspond to speed variations of $\pm 10$ (meters per minute) about average speed of 30 m/mn. The theoretical speeds are calculated from both formulae of page 8 lines 1 and 2 and from the wiping speed obtained in the test at 30 m/mn. Table II is therefore starting from the equilibrium state at 30 m/mn and allows to compare the respectively theoretical and practical values of $V_E$, when the speed is varying of −10 m/mn (V=20 m/mn) or of +10 m/mn (V=40 m/mn) and this for 3 selected densities.

TABLE II

| Density | = I, I | | = I, 2 | | = I, 3 | |
|---|---|---|---|---|---|---|
| wiping speed at 30m/mn | 1590 | | 1450 | | II80 | |
| Variation of V | −I0 | +I0 | −I0 | +I0 | −I0 | +I0 |
| Theoretical wiping speed (m/mn) | I003 | 2196 | 907 | 2005 | 700 | I687 |
| Practical wiping speed (m/mn) | 990 | 2200 | 870 | 2060 | 690 | I720 |

It is to be remarked that the theory is nearly confirmed (about 4% in the most unfavourable case). It is also to be noticed that the practical variation range of $V_E$ is always of a greater amplitude as that forseen by the theory. This can be explained by the loss of efficiency of the wiping due to the fact that the rod is supported by a V-shaped bearing 10 formed in support body 9 made of an elastomer having a modulus of elasticity relatively high (2500 da N/cm$^2$) with regards to that of the rubber (50 daN/cm$^2$ (deca Newtons per square centimeter)) constituting the resilient surface layer 6 of the inking cylinder 5, in the case of the prototype of the test.

Since said modulus of elasticity is high, but however not infinite, a very thin additional film is laminated between the rod 11 and its support 10, said film being added to the film formed by laminating between the rod 11 and the inking cylinder 5, thereby leading to the necessity of somewhat increasing $V_E$ in order to counterbalance this phenomenon. The increase is otherwise partly counterbalanced by the decrease of the viscosity of the ink owing to its thixotropy; for example in the column Δ=1.2, subcolumn −10, of Table II, the practical wiping speed is lower than the theoretical speed, respectively 870 instead of 907, whereas in sub-column +10, the practical wiping speed is higher than the theoretical speed, respectively 2060 instead of 2005. The origin is therefore lower (decrease of viscosity owing to thixotropy) and a greater variation range is required (loss in efficiency owing to support 9 made of elastomer).

INFLUENCE OF THE INK VISCOSITY

No systematical tests have been made on this parameter because the knowledge thereof at the time of the laminating is difficult because of the thixotropy of the inks.

The ink used for these tests was a "Magenta" ink, the viscosity of which at rest position is of 375 poises. When taken from the ink reservoir of the full speed running machine, the viscosity falls to 215 poises. This variation of viscosity partly explains as hereinbefore said, the noted differences between theory and practice.

Furthermore, it is important to note that, with such a so-called short inking, the offset printing is possible with a normal greasy ink, the viscosity of which having not been decreased by adjuvants. This point is very important since offset printing can only be correctly carried out when an ink having a certain tackiness or "tack" is used, the viscosity of said ink being thereby always rather high.

DETERMINATION OF THE PRINTING QUALITY

This determination has been made by printing a test plate having screens at various opacity percentages.

A method has been further defined allowing to objectively evaluate the quality of the printing. The principle of the measure is as follows:

density of colour is measured by means of a densimeter on various films presenting screens graded from 10% (very fine points) to 100% (flat tint);

the relative density is calculated according to the ratio:

$$\frac{\text{density measured on the screen}}{\text{density measured on the flat tint}}$$

with $\Delta_0$ being the density of white and $\Delta_1$ being the density of flat tint;

as shown on annexed FIG. 8, the curve of relative density versus screen opacity T (%) is traced.

As it can be seen on said FIG. 8, the straight line AB is representing an ideal printing in which the colour density is proportional to the screen, the practical result being represented by the curve S. The right part of said curve S is forming with X-axis an angle α, which is more obtuse than the corresponding angle of straight line AB. This angle α is significant of an increase in size of the point higher than normal ("enlargement").

At point N, said enlargement is counterbalanced by disappearing of some of the points. In zone AM, there is partial disappearing of small points (loss of fineness). The tangent of angle α is significant of the point enlargement.

If $\alpha_1$ is constant, for example in the case of a same colour, it is traced the curved AB′ versus $\Delta_0.\Delta_1$. The abscissa of B′ is then significant of said enlargement.

In the case of a figure, the enlargement would be:

$$(100/75)=1.33\rightarrow 33\%$$

Practically, it is often noticed between point P (40%) and point M (50%) a certain discontinuity owing to the phenomenon of points soldering.

Point $D_1$ is representing the residual enlargement end point $D_O$ is representing the loss in fineness. Absolute enlargement could be evaluated in summing up both $D_1$ and $D_0$.

In the case shown in FIG. 8, it can be calculated the following values:

$$\text{loss of fineness } \frac{100}{100-12} = 1.14 \longrightarrow 14\% \quad \text{(a)}$$

$$\text{residual enlargement } \frac{100}{100-13} = 1.15 \longrightarrow 15\% \quad \text{(b)}$$

$$\text{absolute enlargement } \frac{100}{100-(12+13)} = 1.33 \longrightarrow 33\% \quad \text{(c)}$$

This curve allows therefore to compare printings to a reference printing.

In the following Table III, it is given the densities Δ noted for each screen, as well as the values of the evolution of the density versus the percentage of opacity of the screen which is also represented as a curve in FIG.

9, there results having been obtained by means of the test apparatus.

TABLE III

| Real % of opactiy of the screen | Screen density | Flat tint density | Relative density (screen/Flat tint) |
|---|---|---|---|
| 97 | I.I8 | I.20 | 0.983 |
| 92 | I.I6 | I.20 | 0.967 |
| 85 | I.08 | I.20 | 0.900 |
| 75 | 0.96 | I.20 | 0.800 |
| 60 | 0.72 | I.20 | 0.600 |
| 47 | 0.58 | I.20 | 0.483 |
| 34 | 0.37 | I.20 | 0.308 |
| I9 | 0.24 | I.20 | 0.200 |
| I4 | 0.I8 | I.20 | 0.I50 |
| 6 | 0.69 | I.20 | 0.075 |
| "white density" | 0.04 | | |

The above values are coming from measures made on the finest screen (150 lines) of images corresponding to sample B.

It results from the curve of FIG. 9 the following various characteristics of the printing:

loss of fineness (a)

$$\frac{100}{100-4.5} = 1.047, \text{ that is a residual enlargement of } 0.47\%.$$

residual enlargement (b)

$$\frac{100}{100-6} = 1.064, \text{ that is a residual enlargement of } 0.64\%.$$

absolute enlargement (c)

$$\frac{100}{100-(4.5+6)} = 1.117,$$

that is an absolute enlargement of 11.7%.

These values can be considered as significant of a good printing.

Figure 10:
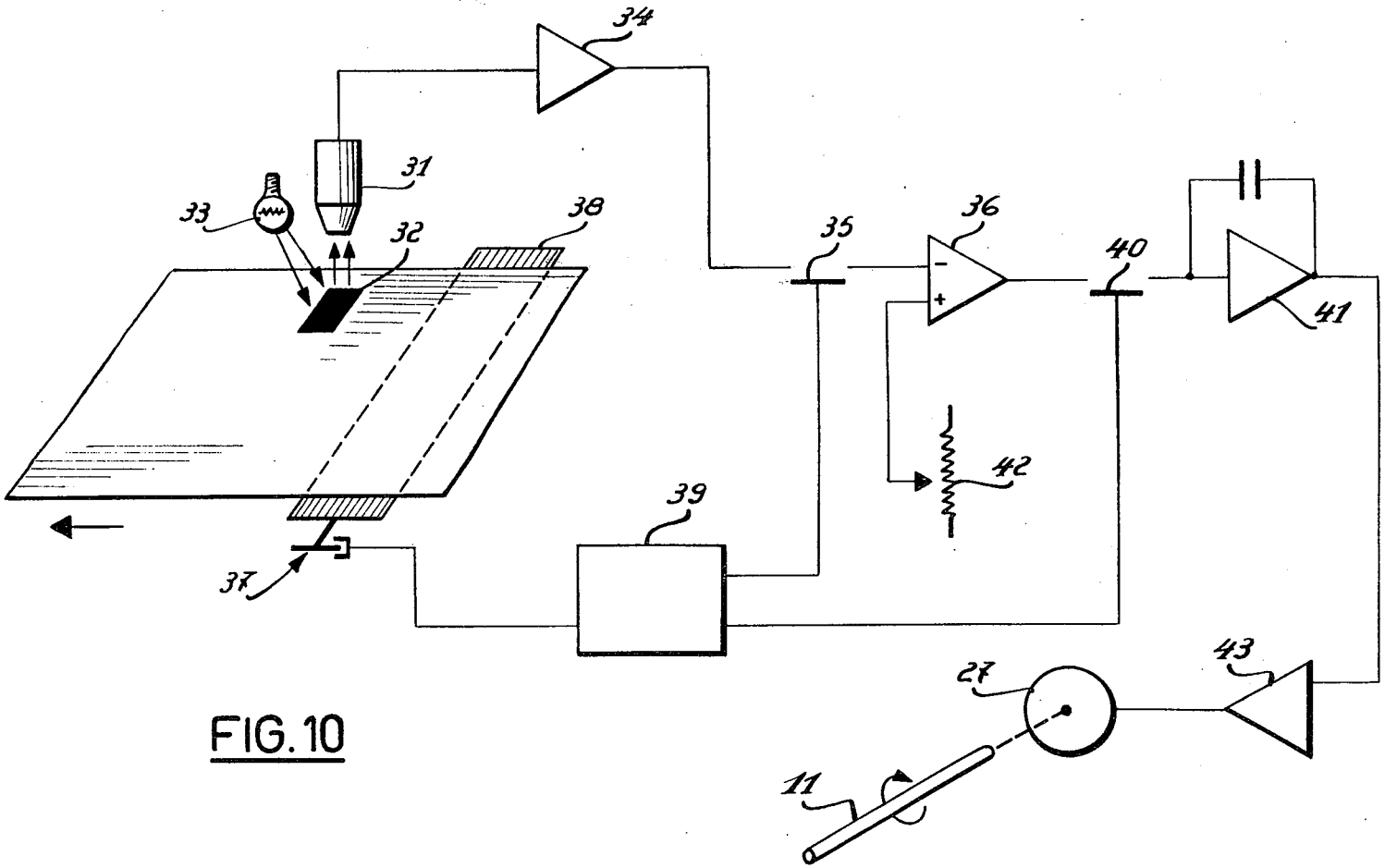
FIG. 10 is a diagram of a control system, used with an inking device according to the invention.

As shown in FIG. 10 it is possible to tie the electrical motor 27, which allows to vary the rotational speed of the wiping rod 11 with a reader of the ink density on the obtained printing, in order to always maintain a correct printing.

A circuit allowing to realize this "feed-back" is illustrated on annexed FIG. 10. This circuit comprises an photo-electric cell 31, which is sensible to the visible spectrum and which reads a printed mark or spot 32 of the tint to be controlled. This mark 32 is illuminated by a light source 33 and the cell 31 intercepts the reflected light rays. The signal delivered by the photoelectric cell 31, which is a function of the effective color of the spot 32, is applied to an amplifier 34, the output of which is connected, through an analogical gate 35, to a comparator 36 constituting in fact an error amplifier.

In order to select the color to be corrected and consequently the printed mark 32 to be watched over by the photo-electric cell 31, a coder 37 is provided, which is interdependent of the printing devic and which is synchronously driven with the printing cylinder 38. This coder 37 emits an impulse which is synchronous with the passage of the mark 32 under the photo-electric cell 31. This impulse is applied to a circuit 39, both outputs of which are respectively connected to the analogical gate 35 and to another analogical gate 40 branched between the comparator 36 and another memorizing amplifier 41.

The error amplifier comparator 36 comprises two inputs, one of which being connected to the analogical gate 35 and the other being connected to the slider of a potentiometer 42, which applies thus to the second input of the amplifier 36 a variable reference signal representing the checking value for the reflectability of spot 32. Thus, in the case of a difference the checking signal provided by the potentiometer 42 and the measure signal obtained from the lecture by the photo-electric cell 31, the comparator 36 gives at its output an error signal, which is memorized in the amplifier 41. The output potential of said amplifier is brought "up to date" at each cycle, that is at each lecture of the printing mark 32.

The potential obtained from the amplifier 41 is used as checking potential, which is applied to an amplifier 43 driving the electrical motor 27 connected to the wiping rod 11, in such a manner that the rotational speed of said rod 11 is always maintained at a value "corresponding" to the desired color.

What is claimed is:

1. A rotary offset printing press for offset printing with greasy ink having a viscosity of at least 50 poise, said press comprising a horizontal rotatable plate cylinder, a horizontal rotatable inking cylinder for inking said plate cylinder, said inking cylinder having a covering layer of flexible plastic material, means for rotating said cylinders in opposite directions at equal peripheral speeds about parallel horizontal axes, and an inking device for applying a thin uniform layer of said greasy ink to said inking cylinder, said inking device comprising a rotary small diameter horizontal wiping rod disposed laterally of said inking cylinder and engaging said inking cylinder in a contact zone extending horizontally along the inking cylinder on the side thereof where the surface of the inking cylinder is moving downwardly, said wiping rod and said contact zone being disposed adjacent a horizontal plane passing through the axis of the inking cylinder and said downward movement of the inking cylinder surface being substantially vertical, means for pressing said wiping rod against and into said covering layer of the inking cylinder in said contact zone rigidly and uniformly along the entire length of the wiping rod, said pressing means comprising a horizontal rigid elongate body having at one side thereof a longitudinal V-shaped groove facing said inking cylinder and rotatably receiving said wiping rod, said elongate body having bearing surfaces in said groove on which said wiping rod bears in line contact, said bearing surfaces being of very hard material selected from the group consisting of very hard metal, and an elastomer having a modulus of elasticity of the order of 2500 daN/cm$^2$, variable speed electric motor means for rotating the wiping rod independently of said inking cylinder at an infinitely variable speed in the same rotary direction as the inking cylinder so as to move the surface of the rod upwardly in said contact zone and thereby wipe said inking cylinder, said variable speed electric motor means driving said wiping rod at speeds in the range of from 630 to 2480 rpm and the surface speed at which said inking cylinder is wiped by said wiping rod being in the range of 20 to 40 m/min, trough means for holding a body of said greasy ink against said inking cylinder in a space extending upwardly from said contact zone for downward removal of an ink film from the body of ink by downward movement of the inking cylinder surface past the wiping rod, and transfer of said film to the plate cylinder, said trough means comprising said horizontal rigid elongate body having at one side thereof said longitudinal V-shaped groove facing said inking cylinder and rotatably receiving said wiping rod, and side plates at opposite ends of said body and embracing opposite end faces of said inking cylinder, said side plates having holes through which said wiping rod extends, said body, side plates, wiping rod and inking cylinder defining a trough to receive said greasy ink, said pressing means pressing said wiping rod into said elastic covering layer of said inking cylinder with such penetration that variation of penetration has little effect on the thickness of said ink film, and means for controlling the speed of said variable speed electric motor means to adjust the speed of rotation of said wiping rod to maintain the optical density of the printed material constant and uniform at a selected value.

2. A rotary offset printing press according to claim 1, including means for reciprocating the wiping rod longitudinally thereof during its rotation by said variable speed electric motor means.

3. A rotary offset printing press according to claim 1, further comprising means for sensing the optical density of an area printed by said press and automatically controlling the speed electric of said variable speed motor means in accordance with said sensed optical density to thereby regulate the thickness of said ink film by automatically controlling the speed of rotation of said wiping rod.

4. A rotary offset printing press according to claim 3, in which said sensing and controlling means comprises a photosensor for sensing the optical density and producing an electrical signal corresponding to said optical density, means for amplifying said signal and means for comparing said signal with a selected standard.

5. A rotary offset printing press according to claim 1, in which said wiping rod has a diameter approximately one twelth that of said inking cylinder.

6. A rotary offset printing press according to claim 1, in which said covering layer of said inking cylinder has a modulus of elasticity of the order of 50 daN/cm$^2$ and the penetration of said wiping rod in said covering layer is between 0.6 and 1.3 mm.

7. In a rotary offset printing press the combination of:

a plate cylinder rotatable about a horizontal axis and carrying a printing plate thereon, an inking cylinder rotatable about a horizontal axis parallel to said plate cylinder axis and contacting said plate cylinder to apply ink to said plate thereon, said inking cylinder having a peripheral surface layer of flexible elastic plastic material, means for rotating said plate cylinder and inking cylinder in opposite directions at equal peripheral speeds, a rigid elongate body extending horizontally along that side of said inking cylinder at which the periphery of said inking cylinder moves downwardly upon said rotation of said inking cylinder, said elongate body extending the length of said inking cylinder and having a longitudinal V-shaped groove facing said inking cylinder, side plates at opposite ends of said elongate body extending toward said inking cylinder and engaging opposite end faces of said inking cylinder with a sealing contact, said side plates having circular holes therein in alignment with said longitudinal groove in said elongate body, a small diameter horizontal wiping rod rotatably received in said longitudinal V-shaped groove of said elongate body and contacting said inking cylinder, said rod extending out through said holes in said side plates, said elongate body, side plates, wiping rod and adjacent portion of said inking cylinder defining an upwardly opening elongate ink well, said rigid elongate body having bearing surfaces in said V-shaped groove on which said wiping rod bears with line contact, said bearing surfaces being of very hard material selected from the group consisting of very hard metal and an elastomer having a modulus of elasticity of the order of 2500 daN/cm$^2$, pressure applying means for pressing said elongate body toward said inking cylinder and thereby pressing said wiping rod against and into said flexible elastic plastic surface layer of said inking cylinder, a body of greasy ink having a viscosity of at least 50 poise in said ink well and retained therein by said elongate body, side plates, wiping rod and inking cylinder, variable speed electric motor means for rotating said wiping rod in the same direction as said inking cylinder, whereby the peripheral surface of said wiping rod engaging the downwardly moving surface of said inking cylinder moves upwardly, thereby wiping said inking cylinder and regulating the thickness of a film of said ink carried by said inking cylinder surface past said wiping rod as a function of the speed of rotation of said wiping rod, said variable speed electric motor means driving said wiping rod at speeds in the range of from 630 to 2480 rpm and the surface speed at which said inking cylinder is wiped by said wiping rod being in the range of 20 to 40 m/min, said pressing means pressing said wiping rod into said flexible elastic plastic surface layer of said inking cylinder with such penetration that variation of penetration has little effect on the thickness of said ink film, and means for controlling the speed of said variable speed electric motor means and thereby controlling the speed of rotation of said wiping rod to maintain the thickness of said ink film on said inking cylinder at a value of the order of 12 microns or less.

8. A rotary offset printing press according to claim 7, further comprising means for sensing the optical density of an area printed by said press and automatically controlling the speed of said variable speed electric motor means in accordance with said sensed optical density to thereby regulate the thickness of said ink film by automatically controlling the speed of rotation of said wiping rod.

9. A rotary offset printing press according to claim 7, in which said covering layer of said inking cylinder has a modulus of elastically of the order of 50 daN/cm$^2$ and the penetration of said wiping rod in said covering layer is between 0.6 and 1.3 mm.

10. A rotary printing press according to claim 1, in which said wiping rod has a diameter approximately one twelth that of said inking cylinder.

* * * * *